United States Patent [19]

Haag

[11] 4,453,756

[45] Jun. 12, 1984

[54] WIRELINE FISHING TOOL

[75] Inventor: James W. Haag, Marrero, La.

[73] Assignee: Texaco Inc., White Plains, N.Y.

[21] Appl. No.: 352,483

[22] Filed: Feb. 25, 1982

[51] Int. Cl.[3] ..... E21B 31/18

[52] U.S. Cl. ..... 294/86.29; 294/86.27; 294/86.3

[58] Field of Search ..... 294/86.17–86.33, 294/100, 110 R, 110 A, 116

[56] References Cited

U.S. PATENT DOCUMENTS

| | | | |
|---|---|---|---|
| 701,654 | 6/1902 | White | 294/86 |
| 972,340 | 10/1910 | Coogan | 294/86 |
| 1,337,476 | 4/1920 | Kliewer | 294/86.27 |
| 1,470,482 | 10/1923 | Rateliffe | 294/86.27 |
| 1,480,378 | 1/1924 | De Armond | 294/86.3 X |
| 1,481,259 | 1/1924 | Harrison | 294/86.28 |
| 1,504,648 | 8/1924 | Skinner | 294/86.28 |
| 1,570,065 | 1/1926 | Jones | 294/86.29 |
| 1,738,789 | 12/1929 | Newkirk | 294/86.27 |
| 1,787,713 | 1/1931 | Yungling | 294/86.3 X |
| 2,346,901 | 4/1944 | Branden | 294/104 |
| 2,594,908 | 4/1952 | Gaulke et al. | 294/100 |
| 3,095,926 | 7/1963 | Rush | 166/55 |

*Primary Examiner*—Johnny D. Cherry

*Attorney, Agent, or Firm*—Robert A. Kulason; Jack H. Park; Henry C. Dearborn

[57] ABSTRACT

A wireline fishing tool for retrieving a fish or object from an inaccesible loction as a broken drill bit deep in a well comprises an elongated rod with two toothed jaws pivotally connected to the lower end thereof and being extendible from a bell shaped housing toward the inaccessible object and being retractable into the housing for closing the jaws around the fish, or object and a shear pin for maintaining the jaws open as the tool is lowered into the well until the jaws contact the object. Additional movement towards the object starts retraction of the jaws into the bell shaped housing, which first shears a shear pin holding the rod extended from the housing while further movement shears the second shear pin holding the jaws open whereby the jaws are then closed tight on the object by contact with the bell shpaed housing and held tight with a ratchet and pawl for locking the jaws and rod in the housing for retrieval at the surface.

2 Claims, 4 Drawing Figures

WIRELINE FISHING TOOL

BACKGROUND OF THE INVENTION

Field of the Invention

This invention pertains to a method of fishing. More specifically, it pertains to a method for retrieval of an object in an inaccessible location and a mechanism for carrying out the method.

A typical example of fishing is an operation to recover from a wellbore any equipment accidentally left or accidentally dropped in there during drilling operations. Also, an operation to remove from an older well certain items of equipment in order that the well may be reconditioned. In a well being drilled, the most common fishing operation is that required by the loss of a bit, one or more drill collars, a part of the string of drill pipe, or a wireline or cable. In reconditioning a well it is often necessary to fish for packers, liners, screen pipe, etc.

This fishing tool is particularly designed for one of the most difficult retrieval jobs, the retrieval of a wireline, as illustrated, in inaccessible locations, i.e. inaccessible that is, to any person or worker having ordinary work tools. The fishing tool is a special tool for recovering objects inadvertently dropped in a well, for example, which could be as deep as over six miles.

OBJECTS OF THE INVENTION

A primary object of this invention is to provide a method for retrieving an object from an inaccessible location.

Another primary object of this invention is to provide a new and better fishing tool for recovery of downhole materials.

A further object of this invention is to provide a mechanism for the retrieval of objects in an inaccessible location that is easy to operate, is of simple configuration, is economical to build and assemble, and is of greater efficiency for the recovery of inaccessible objects.

Other objects and various advantages of the disclosed method of retrieving an inaccessible object and a fishing tool for carrying out the method will be apparent from the following detailed description, together with the accompanying drawings, submitted for purposes of illustration only and not intended to define the scope of the invention, reference being made for that purpose to the subjoined claims.

BRIEF DESCRIPTION OF THE DRAWINGS

The drawings diagramatically illustrate by way of example, not by way of limitation, one form of the invention wherein like reference numerals designate corresponding parts in the several views in which.

Figure 1:
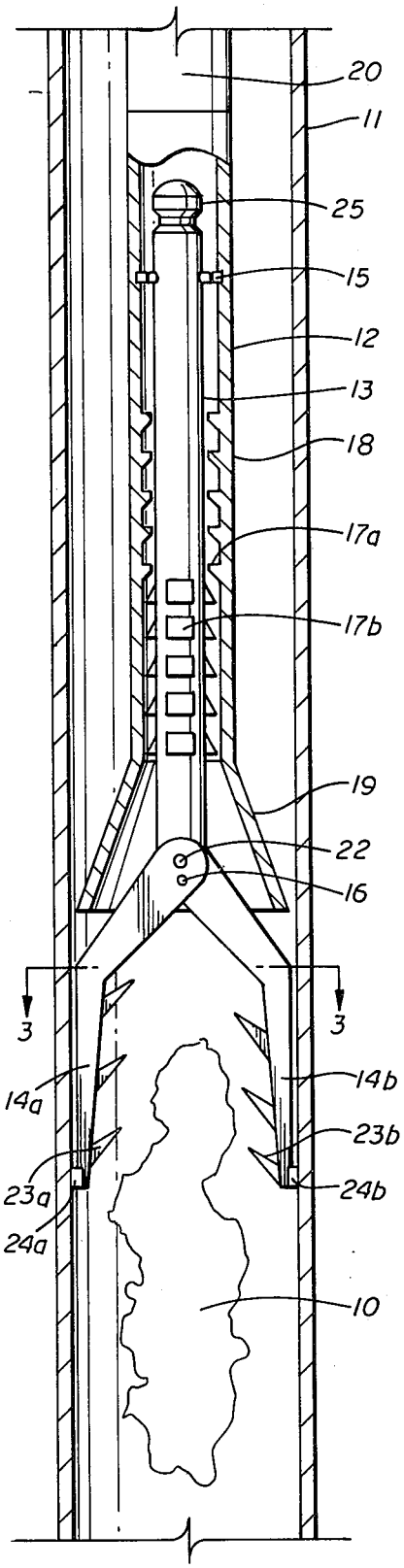
FIG. 1 is a schematic diagrammatic vertical sectional view of the fishing tool in open position for receiving the inaccessible object.

The invention disclosed herein, the scope of which being defined in the appended claims is not limited in its application to the details of construction and arrangement of parts and methods shown and described, since the invention is capable of being in the form of other embodiments and of being practiced or carried out in various other ways. Also, it is to be understood that the phraseology or terminology employed here is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE INVENTIONS

This patent includes two inventions, a method for retrieving an object from an inaccessible location, and a mechanism for practicing the above method comprising a fishing tool for recovery of downhole material.

While various fishing tools may be utilized to carry out the new method, FIGS. 1–4 disclose one which will be used to illustrate the following methods.

Basically, one method for retrieval of a fish or object (10, FIG. 1) in an inaccessible location with a fishing tool having two jaws (14*a*, 14*b*) pivoted to an end of a rod (13) and all of which being retractable into a bell shaped housing (19) comprises the steps of (1) moving the toothed jaws held locked with locking means (shear pin 16) in open position toward and into contact with the inaccessible fish, and (2) unlocking the toothed jaws by contacting thereof with the bell shaped housing side walls for biasing the jaws toward closed position to thereby shear the pin (16) for grasping the inaccessible fish (10) for retrieval thereof at the surface of a well, for example.

Another basic method comprises the steps of, (1) connecting a rod (13) to an elongated housing portion (18) with a locking means or shear pin (15), and (2) unlocking means or shearing the shear pin (15) with contact of the toothed jaws (14*a*, 14*b*) with the inaccessible object for permitting retraction of the rod into the elongated housing portion, for retrieval thereof at the surface.

Figure 2:
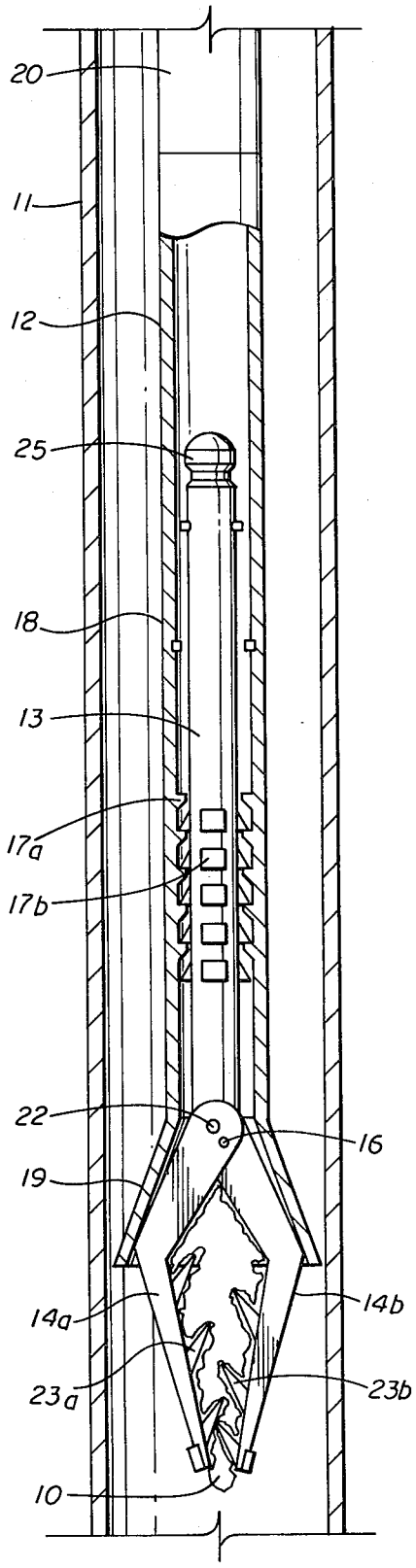
FIG. 2 is a view similar to FIG. 1 showing the fishing tool after having closed over the object and ready for raising to the surface.
Figure 3:
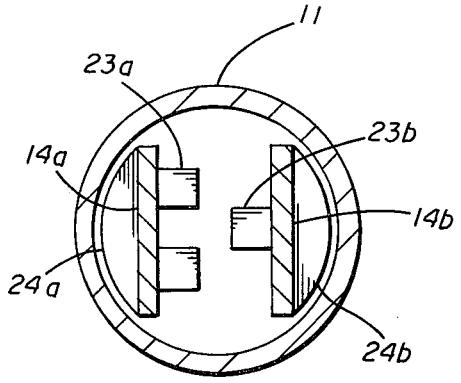
FIG. 3 is a section at 3—3 on FIG. 1.

Another basic method includes the following steps, (1) connecting an elongated rod (13) in a housing (18, 19) with a lock, such as ratchet teeth and pawl (17*a*, 17*b*) illustrated in FIGS. 1 and 2, for permitting retraction of the rod (and ratchet teeth pivoted thereto) into the bell shaped and elongated housing subsequent to contact with the inaccessible object, but preventing extension of the rod from the housing, and (2) locking the lock (pawl and ratchet teeth) with retraction of the rod into the elongated housing portion, i.e. engaging of the rod or pawl (17*b*) with the ratchet teeth (17*a*).

THE PREFERRED EMBODIMENT FOR PRACTICING THE INVENTION

The above methods for for retrieval of an object in an inaccessible location may be performed by other mechanisms than that disclosed in the FIGURES. The mechanism disclosed herein may be operated by other methods than those disclosed, as by hand. Also the disclosed mechanism can be used to practice another and materially different method. However, the preferred system for performing the method is disclosed in FIGS. 1–4.

FIG. 1, a schematic diagrammatic vertical sectional view of the fishing tool in open position for approaching the inaccessible fish or object 10 in a well 11, for example, comprises basically the housing 12, a rod 13 with jaws 14*a*, 14*b*, and in particular, detachable locking means 15, 16, and 17*a*, 17*b* for connecting these various elements together for forming the new and novel efficient fishing tool.

A fish is any broken or stuck object of equipment in a well, such as bit parts, other small items of equipment, or even a large portion of the drill string in addition to those articles described above.

An elongated housing, 12, FIG. 1, having an upper neck portion 18 connected to a head 25 for being fished if necessary and a lower bell shaped portion 19 for attaching to the bottom of a work string 20 with a conventional latch (not shown) is illustrated for carrying the elongated rod 13 inside thereof and having two toothed jaws 14*a*, 14*b* pivoted to the lower end thereof with pivot pin 22.

Figure 4:
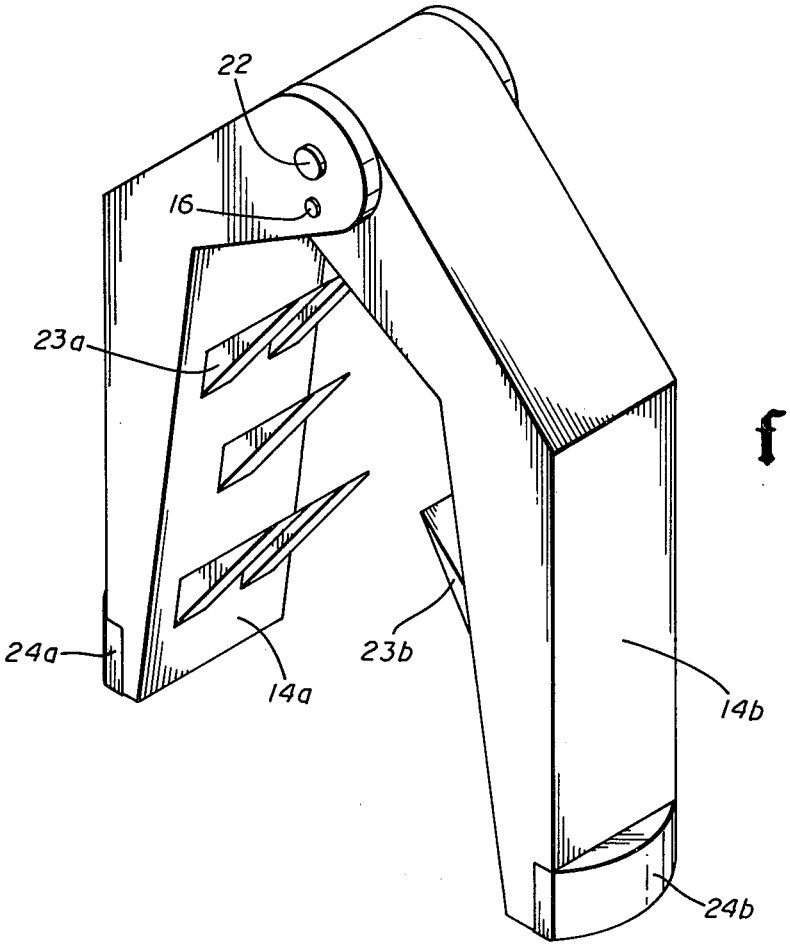
FIG. 4 is a perspective view of the jaws per se, in open position, showing the mating teeth in particular.

Jaws 14*a*, 14*b*, FIG. 4, have mating teeth 23*a* and 23*b*, respectively, as illustrated, one tooth on one jaw being opposite to and fitting in between two teeth on the other jaw, with alternate rows of teeth on each jaw. Wear pads 24*a*, 24*b*, formed of rubber or the like protect the outside surface of the lower ends or tips of the jaws as they are lowered in the well.

Additional new features are the following detachable locks.

A locking means, such as but not limited to, the shear pin 15 is mounted on the housing lower neck portion 18 for penetrating and connecting the upper end of the rod 13 to the housing elongated portion 18. Then upon firm contact of the jaws 14*a*, 14*b*, with the inaccessible object 10, and further continued movement of the work string 20 and housing 12 connected thereto toward the object, the locking shear pin 15 is sheared for permitting further retractive movement of the jaws into the bell shaped lower end 19 of the housing.

With continued movement of the jaws, 14*a*, 14*b*, FIG. 1, into the housing, the tapered walls of the bell shaped housing portion 19, FIG. 2, bias the jaws closed. This closing action of the jaws shears the shear pin 16 so that the jaws are closed tight on each other, locking the inaccessible object 10 therebetween as illustrated in FIG. 2.

As the housing 12, FIG. 1, is moved toward the inaccessible object 10 before and after contact therewith, the rod 13 and jaws 14*a*, 14*b* have been retracted well into the housing, with the spring clips or pawl, 17*b* on the external surface of the retracting rod 13 riding over the stops or ratchet teeth 17*a* on the internal surface of housing elongated portion 18 to the fartherest retracted position of FIG. 2. There the ratchet teeth 17*a* and pawls 17*b* lock the rod 13 firmly in housing 18 and the jaws 14*a*, 14*b* with object 10 firmly in bell shaped housing 19 for preventing backward motion of the rod and for retrieval at the surface.

After the finishing tool is removed from the well casing 11, the locks 17*a*, 17*b*, are released, as by any conventional means, or by hand, and the rod 13 and jaws 14*a*, 14*b* are lowered or removed from the respective housing portions 18, 19 for recovery of the object or fish.

Accordingly, it will be seen that the disclosed fishing tool will operate in a manner which meets each of the objects set forth hereinbefore.

While only a few methods of the invention and one mechanism for carrying out the methods has been disclosed, it will be evident that various other methods and modifications are possible in the arrangement and construction of the disclosed methods and fishing tool without departing from the scope of the invention and it is accordingly desired to comprehend within the purview of this invention such modifications as may be considered to fall within the scope of the appended claims.

I claim:

1. A fishing tool for retrieving a fish from an inaccessible location comprising, (a) rod means having two toothed jaws pivoted to an outer end thereof and being extendible from a bell shaped housing means toward the fish and being retractable into said housing means for closing the jaws, (b) first locking means for maintaining said tooth jaws open while being moved toward the fish and for being unlocked for permitting closing of said toothed jaws, (c) said rod means being connected to said housing means with second locking means, (d) said first locking means being responsive to said bell shaped housing means for being unlocked thereby for permitting closing of said jaws for grasping said fish for retrieval thereof, and (e) said second locking means being responsive to said rod means for being unlocked thereby for permitting retraction of said toothed jaws into said bell shaped housing means for retrieval thereof.

2. A fishing tool as recited in claim 1 wherein, (a) said rod means is attachable to said bell shaped housing means with third locking means, and (b) said third locking means being responsive to said rod means for being locked in retracted position for locking said closed jaws in said bell shaped housing means for recovery of the fish.

* * * * *